US009955049B2

(12) United States Patent
Pritz

(10) Patent No.: US 9,955,049 B2
(45) Date of Patent: Apr. 24, 2018

(54) HELMET WITH INTEGRATED ELECTRONICS AND HELMET VISOR CONTROLS

(71) Applicant: Bell Sports, Inc., Scotts Valley, CA (US)

(72) Inventor: Ben D. Pritz, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 237 days.

(21) Appl. No.: 14/812,135

(22) Filed: Jul. 29, 2015

(65) Prior Publication Data

US 2016/0029729 A1 Feb. 4, 2016

Related U.S. Application Data

(60) Provisional application No. 62/031,536, filed on Jul. 31, 2014.

(51) Int. Cl.

| | |
|---|---|
| ***A42B 3/04*** | (2006.01) |
| ***A42B 3/22*** | (2006.01) |
| ***A42B 1/24*** | (2006.01) |
| ***H04N 5/225*** | (2006.01) |

(52) U.S. Cl.

CPC ..... *H04N 5/2252* (2013.01); *A42B 3/042* (2013.01); *A42B 3/22* (2013.01); *A42B 3/227* (2013.01)

(58) Field of Classification Search

CPC ..... G02B 27/017; G02B 27/0176; G02B 27/0172; G02B 27/0174; H04N 5/2252; A42B 3/042; A42B 3/0433; A42B 3/22; A42B 3/30; A42B 3/306; A42B 3/224;

(Continued)

(56) References Cited

U.S. PATENT DOCUMENTS 3,845,389 A * 10/1974 Phillips ..... A42B 3/30 2/5
4,434,514 A * 3/1984 Sundahl ..... A42B 3/281 2/171.3

(Continued)

FOREIGN PATENT DOCUMENTS

DE 19542835 A1 5/1997
FR 2612351 9/1988

(Continued)

*Primary Examiner* — Jameson Collier
*Assistant Examiner* — Heather Mangine
(74) *Attorney, Agent, or Firm* — Booth Udall Fuller, PLC

(57) ABSTRACT

A helmet can include a helmet body comprising an energy-absorbing layer and an outer shell disposed over the energy-absorbing layer. An electronic device can be integrated with the helmet body. A first electrical contact can be formed at an exterior of the outer shell and adapted to be in electrical communication with the electronic device. A helmet visor can be coupled to the helmet body with at least one visor arm, the helmet visor comprising controls integrated within the visor. A second electrical contact can be formed at an inner surface of the at least one visor arm and adapted to be in electrical communication with the controls integrated within the visor. The second electrical contact can be adapted to mateably couple with the first electrical contact such that the electronic device and the controls are adapted to be in electrical contact.

14 Claims, 3 Drawing Sheets

(58) Field of Classification Search
CPC ..... A42B 3/12; A42B 1/069; A42B 1/242; A42B 1/245
USPC ..... 2/422, 6.3, 6.5, 6.7, 15, 5, 410; 362/105, 362/106; 351/155
See application file for complete search history.

(56) References Cited

U.S. PATENT DOCUMENTS 5,329,637 A * 7/1994 Walker ..... A42B 3/044 2/5
5,510,961 A * 4/1996 Peng ..... A42B 1/242 2/209.12
5,537,092 A * 7/1996 Suzuki ..... A42B 3/042 340/432
5,682,172 A * 10/1997 Travers ..... A42B 3/042 345/8
5,691,514 A * 11/1997 Landis ..... A42B 3/30 181/129
5,694,650 A * 12/1997 Hong ..... A42B 3/245 2/15
5,701,607 A * 12/1997 Kaiser ..... A42B 1/248 2/10
6,717,737 B1 * 4/2004 Haglund ..... G02B 27/017 345/7
7,080,414 B1 * 7/2006 Montero ..... A42B 3/224 2/424
7,303,302 B2 * 12/2007 Harris ..... A42B 3/0406 2/424
7,519,405 B1 * 4/2009 Brent ..... A42B 3/30 340/539.1
8,908,389 B2 * 12/2014 Teetzel ..... F41H 1/04 2/205
2002/0186180 A1 * 12/2002 Duda ..... A42B 1/245 345/8
2003/0217745 A1 * 11/2003 Guay ..... A42B 3/10 128/201.22
2006/0198122 A1 * 9/2006 Senter ..... A42B 3/044 362/105
2007/0074335 A1 4/2007 Gafforio et al.
2008/0010721 A1 * 1/2008 Campbell ..... A42B 1/069 2/181.4
2011/0088142 A1 * 4/2011 Holley ..... A42B 1/245 2/209.13
2012/0050607 A1 3/2012 Sims et al.
2013/0215281 A1 * 8/2013 Hobby ..... G06F 3/005 348/207.1
2014/0000013 A1 * 1/2014 Redpath ..... A42B 3/04 2/422
2014/0075655 A1 * 3/2014 Ratner ..... A42B 3/042 2/422
2015/0063777 A1 * 3/2015 Letke ..... A42B 1/244 386/224
2015/0130945 A1 * 5/2015 Yu ..... H04N 7/181 348/158

FOREIGN PATENT DOCUMENTS

RU 137742 U1 2/2014
RU 2535229 C2 12/2014
WO WO 9518490 A1 * 7/1995 ..... A42B 1/245
WO WO2012060506 11/2010

* cited by examiner

HELMET WITH INTEGRATED ELECTRONICS AND HELMET VISOR CONTROLS

RELATED APPLICATIONS

This application claims the benefit of U.S. provisional patent application 62/031,536, filed Jul. 31, 2014 titled "Helmet Visor With Integrated Electronic Controls," the entirety of the disclosure of which is incorporated by this reference.

TECHNICAL FIELD

This disclosure relates to a helmet comprising integrated electronics and helmet visor controls, in which the integrated electronics can be disposed on or within the helmet body and integrated controls for the electronics can be disposed within or placed on the helmet visor. The helmet comprising integrated electronics and helmet visor controls can be employed wherever a conventional helmet is used with additional benefits as described herein.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

SUMMARY

A need exists for improvements to helmets with integrated electronics and control of the same. Accordingly, in an aspect, a helmet may comprise a helmet body comprising an energy-absorbing layer and an outer shell disposed over, and coupled to, the energy-absorbing layer, an electronic device integrated with the helmet body, a first electrical contact formed at an exterior of the outer shell and adapted to be in electrical communication with the electronic device, a helmet visor coupled to the helmet body with at least one visor arm, the helmet visor comprising controls integrated within the visor, and a second electrical contact formed at an inner surface of the at least one visor arm and adapted to be in electrical communication with the controls integrated within the visor, the second electrical contact being adapted to mateably couple with the first electrical contact at an interface between the first electrical contact and the second electrical contact such that the electronic device and the controls integrated within the visor are adapted to be in electrical contact with each other through the interface.

Particular embodiments may comprise one or more of the following. The helmet visor may be releasably coupled to the helmet body. The controls integrated within the helmet visor may be formed as a plurality of buttons. The plurality of buttons may comprise a unitary protective cover adapted to prevent debris from contaminating the plurality of buttons. The controls may be disposed on an underside of the helmet visor at a position that is within a field of view of the helmet, such that the controls are visible by a helmet user when the helmet is worn by the helmet user. The electronic device integrated with the helmet body may comprise a video recording device with a lens disposed over the outer shell. The at least one visor arm may comprise a first visor arm and a second visor arm opposite the first visor arm, the first visor arm and the second visor arm being adapted to be coupled to the helmet body near an upper corner of a helmet faceport.

In another aspect, a helmet may comprise a helmet body, an electronic device integrated with the helmet body, a first electrical contact formed at an exterior of the outer shell and adapted to be in electrical communication with the electronic device, a helmet visor coupled to the helmet body with at least one visor arm, the helmet visor comprising controls integrated within the visor, and a second electrical contact formed at an inner surface of the at least one visor arm and adapted to mateably couple with the first electrical contact such that the electronic device and the controls integrated within the visor are adapted to be in electrical contact with each other.

Particular embodiments may comprise one or more of the following. The helmet visor may be releasably coupled to the helmet body. The controls integrated within the helmet visor may be formed as a plurality of buttons. The controls may be disposed on an underside of the helmet visor at a position that is within a field of view of the helmet, such that the controls are visible by a helmet user when the helmet is worn by the helmet user. The electronic device integrated with the helmet body may comprise a video recording device with a lens disposed over the outer shell. The at least one visor arm may comprise a first visor arm and a second visor arm opposite the first visor arm, the first visor arm and the second visor arm being adapted to be coupled to the helmet body near an upper corner of a helmet faceport.

According to another aspect, a helmet may comprise a helmet body, an electronic device integrated with the helmet body, a first electrical contact formed at an exterior of the outer shell, a helmet visor coupled to the helmet body, the helmet visor comprising controls integrated within the visor, and a second electrical contact formed on the visor and adapted to mateably couple with the first electrical contact.

Particular embodiments may comprise one or more of the following. The helmet visor may be releasably coupled to the helmet body. The controls integrated within the helmet visor may be formed as a plurality of buttons. The plurality of buttons may comprise a unitary protective cover adapted to prevent debris from contaminating the plurality of buttons. The controls may be disposed on an underside of the helmet visor at a position that is within a field of view of the helmet, such that the controls are visible by a helmet user when the helmet is worn by the helmet user. The electronic device integrated with the helmet body may comprise a video recording device with a lens disposed over the outer shell. The at least one visor arm may comprise a first visor arm and a second visor arm opposite the first visor arm, the first visor arm and the second visor arm being adapted to be coupled to the helmet body near an upper corner of a helmet faceport.

DETAILED DESCRIPTION

Figure 1:
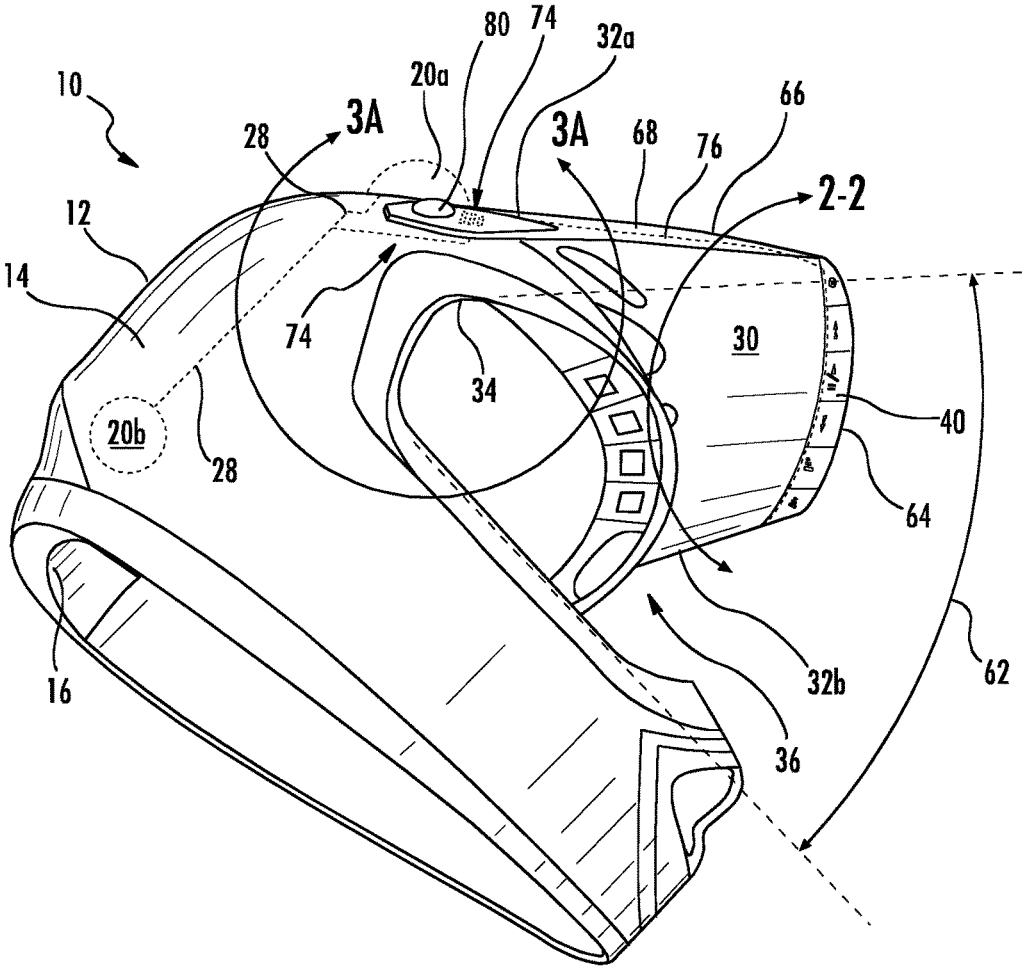
FIG. 1 shows a perspective view of a helmet comprising integrated electronics and helmet visor controls.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a protective helmet that can include an outer shell and an inner energy-absorbing layer, such as foam. The protective helmet can be a bike helmet used for mountain biking, motocross, powersports, other sports, and in other industries using protective headwear or helmets including visors, for individuals such as construction workers, soldiers, fire fighters, and pilots. Each of the above listed sports, occupations, or activities can use a helmet that includes single or multi-impact rated protective material base that can also include comfort padding or support material on at least a portion of the inside of the helmet.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising hard-shell helmets, the disclosure also relates and applies to in-molded helmets and other helmets.

FIG. 1 shows a helmet 10, which can comprise a hard shell helmet of the type typically worn for powersports activities, such as dirt bike riding or motocross racing. The helmet 10 can comprise a helmet body 12 or main portion of the helmet that excludes straps visors, or other subcomponents. The helmet body 12 can comprise an outer shell 14 and an energy-absorbing layer or impact liner 16 that is couple to, and contained within, the outer shell 14. The outer shell 14 can be disposed over, and coupled to, the energy-absorbing layer 16. The outer shell 14 can be a hard shell made of plastics, such as ABS or other similar material, as well as being made of fiberglass, carbon fiber, or other suitable material. The outer shell 14 can be formed by injection molding or other suitable process that allows for the molding, casting, or forming of the outer shell 14. The energy-absorbing layer 16 can comprise foam or other material such as expanded polypropylene (EPP), expanded polystyrene (EPS), expanded polyurethane (EPU), or expanded polyolefin (EPO) that will absorb and manage energy during an impact in order to manage energy applied to a user's head, protect a user's head during an impact, or both.

One or more electronic devices 20 can be integrated with the helmet body 12. The electronic device 20 can comprise a camera, a video camera, a panoramic or 360 degree camera, a video recording device, an audio device, an MP3 device, a radio, a walkie-talkie, other audio or visual recording or displaying devices, or one or more transmitters for transmitting a signal to a receiving device away from, or separate from, the helmet 10, such as a cell phone or portable handheld communication device. The electronic device 20 can be formed as an electronic device 20*a* that is contained partially within the helmet body 12 so that a part of the electronic device 20*a* is exposed outside of the helmet, such as above or outside the outer shell 14 of the helmet. As a non-limiting example, the electronic device 20*a* can be a panoramic 360-degree camera positioned at a top of the helmet 10 with one or more lenses positioned at or near a top of the outer shell 14 to record video, such as of a race or of a riding experience. The electronic device 20, in particular embodiments, can also be formed as an electronic device 20*b* that is completely contained within the helmet body 12 so that no part of the electronic device 20*b* is exposed outside of the helmet. As a non-limiting example, the electronic device 20*a* can be an audio device or MP3 player with speakers that transmit audio signals to a user wearing the helmet, or electronic components for transmitting signals away from, or to, electronic devices away from a helmet, such as portable hand-held electronics devices, such as smartphones, or other devices, kiosks, or machines positioned along a course.

The electronic device 20 can be electrically coupled to a helmet electrical contact or first electrical contact 26 (shown in FIG. 3B) that is formed at an exterior of the outer shell 14 and adapted to be in electrical communication with the electronic device 20. "Electrically coupled" includes conductively coupled and adapted for electrical coupling with or without current flowing through the conductors. For example, the electronic device 20 can be coupled or physically in contact with the helmet electrical contact 26 without carrying an electrical current or being electrically charged. The electronic device 20 can be adapted to be electrically coupled to the helmet electrical contact 26 by being in direct physical contact with the helmet electrical contact 26, or by being indirectly in contact with the helmet electrical contact 26, such as by being in direct physical contact with one or more intermediate structures, such as wiring 28, which can in turn be in direct physical contact with the helmet electrical contact 26. The wiring 28 can be formed of any conductive material, including metals such as copper, which can carry, conduct, or transmit, an electrical current or signal. The wiring 28, when present, can be integrally formed as part of the helmet body, or disposed within the helmet body 12, such as between one or more layers of the helmet body 12, so as to be out of sight and protected from damage and wear.

The helmet 10 can further comprise a visor or helmet visor 30 that can be coupled or releasably coupled to the helmet body 12 with at least one visor arm 32. The at least one visor arm can comprise any number of arms, and in some embodiments will comprise a first or right visor arm 32*a* and second or left visor arm 32*b* opposite the first visor arm 32*a*. The first visor arm 32*a* and the second visor arm 32*b* can be adapted to be coupled to the helmet body 12 over the helmet electrical contact 26 near an upper corner 34 of a helmet faceport 36.

The helmet visor 30 can comprise controls or electronic device controls 40 integrated within the visor 30. The controls 40 can be electrically coupled, or adapted to be electrically coupled, to the one or more electronic devices 20 within the helmet 10. As such, the number and type of controls can vary based on the types of electronic devices 20 integrated or used with the helmet 10, and the intended application or use of the helmet 10 with the particular electronic device 20. In some instances, the controls 40 can be formed as plurality of buttons 42, which can include options to record 44, fast-forward or skip 46, play/pause 48, rewind or skip 50, stop, transmit or receive with wires 52, and transmit or receive wirelessly 54, as shown by way of non-limiting example in FIG. 2.

Figure 2:
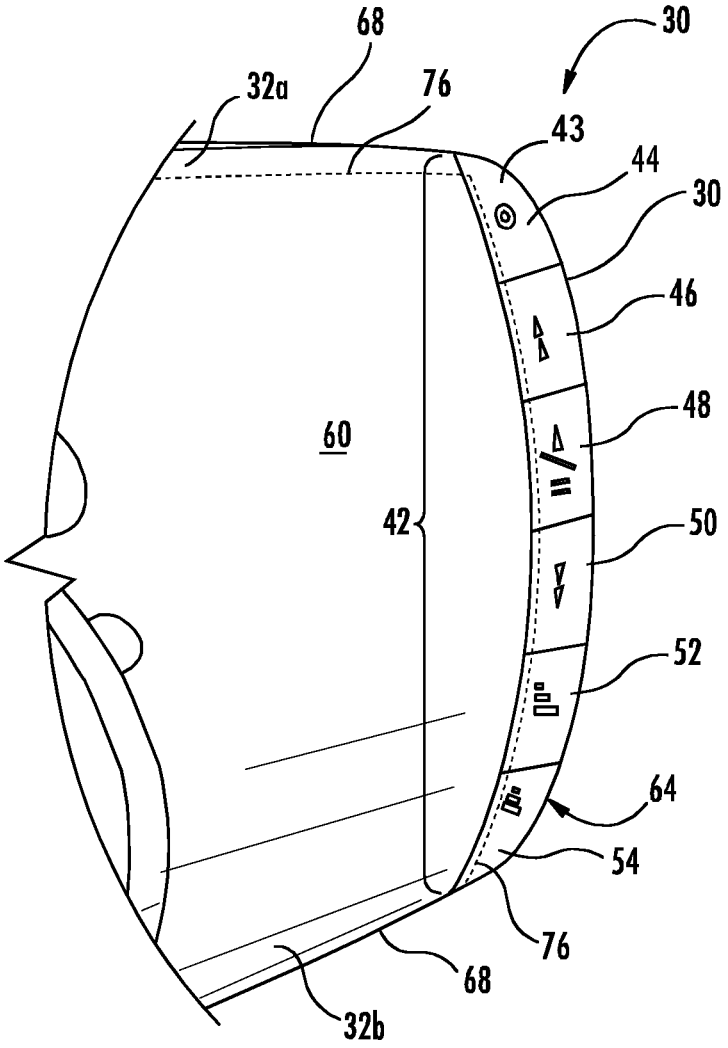
FIG. 2 shows a perspective view of an underside of a helmet visor comprising integrated visor controls.

FIG. 2 also shows the controls 40 or plurality of buttons 42 can be positioned or disposed at any convenient location on the visor 30, such as at, or on, an underside 60 of the helmet visor 30 at a position that is within a field of view (FOV) 62 of the helmet 10, such that the controls 40 are visible by a helmet user when the helmet 10 is worn by the helmet user. In some instances the controls 40 will be on the underside 60 of the visor 30 while being disposed or positioned along a front or leading edge 64 of the visor 30. Additionally, the controls 40 may also be disposed or positioned along the first visor arm 32*a*, the second visor arm 32*b*, and/or other portions of the underside 60. In other instances, the controls 40 can be positioned on a topside or surface 66 of the visor 30 opposite the underside 60 of the visor 30. In yet other instances, the controls 40 can be positioned on a lateral portion 68 of the visor 30, such as along a visor arm 32 on one or more surfaces that are perpendicular or substantially perpendicular to the underside 60 or the topside 66 of the visor 30, wherein substantially perpendicular includes angles within ranges of 0-15, 0-30, or 0-45 degrees of the underside 60 or the topside 66.

The helmet 10 can further comprise a visor electrical contact or second electrical contact 70 formed at an inner or medial surface 72 of the at least one visor arm 32 and adapted to be in electrical communication with the controls 40 integrated within the visor 30. The visor electrical contact 70 can be adapted to be mateably coupled with the helmet electrical contact 27 at an interface 74 between the helmet electrical contact 26 and the visor electrical contact 70 such that the one or more electronic devices 20 and the controls 40 integrated within the visor 30 can be, or can be adapted to be, in electrical contact with each other through the interface 74. Interface 74, including helmet electrical contact 26 and visor electrical contact 70, can be coupled to the controls 40 by being in direct contact, such as physical contact, or by being in indirect contact, such as by being in indirect physical or electrical contact through wiring 28, through wiring or an electrical connector, conduit, or coupling device 76, or both.

The wiring 76 can, when present, be integrally formed as part of the visor 30, so as to be out of sight and protected from damage and wear, similar to wiring 28 being disposed within or between layers of helmet body 12. The wiring 76 can be formed of any conductive material, including metals such as copper, that can carry, conduct, or transmit, an electrical current or signal. The wiring 76 can be disposed at, or extend along, an underside 60 of the visor, along a topside 66 of the visor, or be embedded within a thickness of the visor 30. In instances when wireless connections or communication is desired, such as wireless communication between one or more electronic devices 20 and a portable handheld electronic communication device, such as a smart phone, the wiring 76 can allow for the hardware and components supporting the wireless transmission to be located in the helmet body 12 rather than in or on the visor 30. Signals or inputs can then be transmitted through one or more wires or connectors from the visor 30 into the helmet body 12, such as through wiring 76 and interface 74. From the helmet body 12, the signal can then be transmitted wirelessly so that the size, weight, bulk, and power or energy consumption requirements of the wireless communication hardware need not be stored in the visor 30, where the controls 40 are located. As a result, a thin, minimalist visor 30 can be maintained, similar to conventional visors used for motocross and other helmets, while still including the additional functionality of controls 40.

The additional functionality of the controls 40 being integrated within the visor 30 can be accomplished with the controls 40 being electrically coupled to the visor electrical contact 70 and adapted to be in electrical communication with the electronic device 20. For example, the controls 40 can be coupled or physically in contact with the visor electrical contact 70 without carrying an electrical current or being electrically charged. The one or more electronic devices 20 can also be adapted to be electrically coupled to the controls 40 by being indirectly in contact with the visor electrical contact 70, such as by being in direct physical contact with one or more intermediate structures, such as the wiring 76, which can in turn be in direct physical contact with the visor electrical contact 70 and the controls 40. The wiring 76, can be integrally formed as part of the visor 30, and the visor arm 32, such as between one or more layers of the visor 30, so as to be out of sight and protected from damage and wear. A portion of the wiring 76 is also shown in FIG. 2.

Thus, formation of the helmet 10 as shown and discussed herein provides for a number of advantages with respect to conventional helmets. Helmet 10 provides for compact integration of electronic devices 20 within the helmet 10, for increased ease of use with the placement and interconnectedness of controls 40 through interface 74, for optimized functionality, and for facilitating manufacturing and assembly. More particularly, controls 40 are integrally formed as part of the helmet visor 30 to allow for easy access of the controls 40 by a user wearing and using the helmet 10 and the one or more electronic devices 20, and by providing for electrical connection and electrical communication through interface 74 between helmet electrical contact 28 and visor electrical contact 70. The one or more electronic devices 20 can be controlled by inputs from the controls 40 on the visor 30; and, the electronic devices 20 can operate by being coupled with wires, wirelessly (such as by Bluetooth or other connection), or both. The electronic devices 20, the devices communicating, receiving, or transmitting to or from the electronic devices 20, or both, can include one or more freestanding, independent, off-the-shelf, or over-the-counter stand-alone products, as they relate to the helmet 10.

Figure 3A:
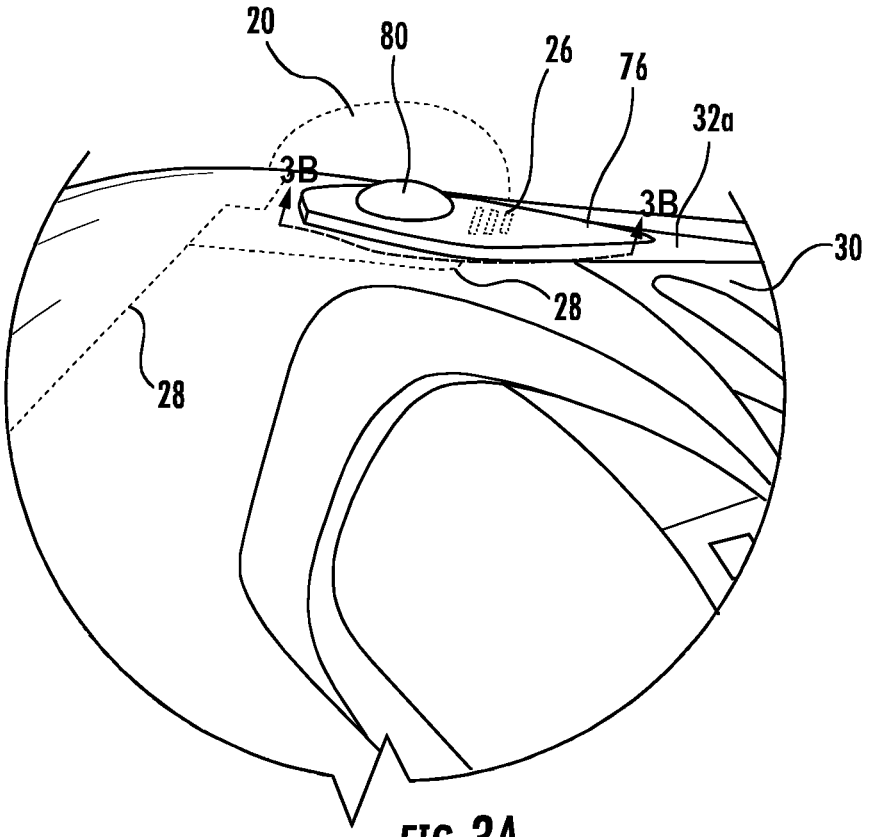
FIGS. 3A and 3B show detail of an interface between the helmet body and the helmet visor.
Figure 3B:
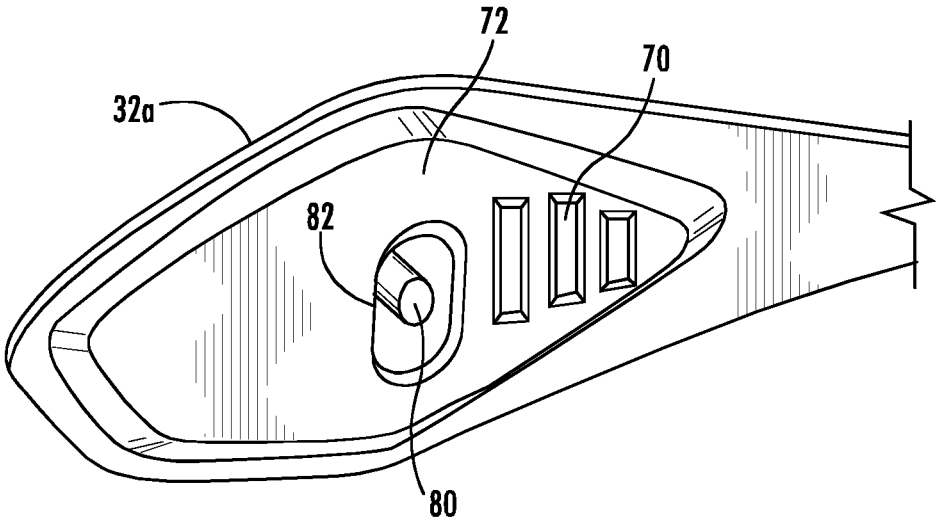

FIG. 1 also includes section line 2-2 and section line 3B-3B, which indicate portions of the helmet 10 shown and discussed in greater detail with respect to FIG. 2 and FIG. 3B, respectively. FIG. 2 provides an enlarged or close-up view of the portion of the visor 30 and the controls 40 indicated within section line 2-2 shown in FIG. 1. FIG. 2 illustrates a non-limiting example of controls 40 formed as a plurality of buttons 42, such as video recording buttons or audio control buttons that can be integrally formed as part of a visor 30. As a non-limiting example, the buttons 42 can be formed of a unitary protective cover or membrane panel 43 with a soft or deformable texture so that the controls 40 or the buttons 42 or can be depressed or engaged to allow for activation of an underlying function or desired feature of the electronic device 20, such as playing, pausing, skipping forward, fast-forwarding, skipping backward, reversing, stopping, and recording. More specifically, as shown in FIG. 2, the controls 40 and the plurality of buttons 42 can comprise a record button 44, a fast-forward or skip button 46, a play/pause button 48, a rewind or skip button 50, a transmit with wires button 52, and a transmit wirelessly button 54, as well as a stop button or any other desired button. By forming the plurality of buttons 42 as part of the single membrane 42, electrical features and components such as electrical components of controls 40 and wiring 76 that has been integrated within the helmet 10 can be environmentally protected by eliminating gaps or spaces between the controls 40 or buttons 42, thereby removing entrance points from which water, dirt, mud, or other contaminates could harm the electrical features and components associated with the controls 40 and the buttons 42.

The controls 40, the buttons 42, or both, can be disposed on the underside or under surface 60 of the visor 30, for easy user access. Buttons 42 can also be disposed on lateral sides of the visor 30, on the visor arms 32, on topside 66 of the visor 30, or at any suitable surface of the visor 30. In some embodiments, the controls 40 or buttons 42 can be disposed on more than one of the above-mentioned surfaces. By positioning the controls 40 or buttons 42 on the underside 60 of the visor 30, and within the FOV 62, the user may have the particular advantage of being able to see the controls 40 or buttons 42 increasing an ease of pressing or activating a desired control 40 or button 42.

Additionally, the order or sequence of the buttons 42, such as one or more of the buttons 44-54, is not limited only to the order presented in FIG. 2. In fact, in some embodiments, instead of having a function of controls 40 or buttons 42 constantly or fixedly assigned to particular controls or buttons at a predetermined physical location, instead button function can be user assigned, based on user preference, to a desired button location. Thus, for controls 40 and buttons 42 with assignable function, moving from left to right along a front edge 64 of the visor 30, an order of button function could be: record, fast-forward, play, and rewind. Alternatively, another user could desire a different order and could assign functions to the buttons 42 from left to right along the front edge 64 of: rewind, play, fast-forward, and record. As functions can be assignable and allocated by a user to various buttons 42, some buttons can be left without a function so that spaces or physical separation exits between various buttons 42 with assigned function.

FIGS. 3A and 3B provide additional detail of the helmet 10 and an enlarged or close-up view of the portion of the visor 30 and visor arm 32 that connect or come in contact with the helmet body 12 at or near the upper corners 34 of the helmet faceport 36, as shown by section line 3A-3A in FIG. 1. As used herein, near the upper corner 34 of the helmet faceport 36 can include distances or offsets in a range of 0-10 centimeters (cm), 2-8 cm, 4-7 cm, or 6 cm+/−1 less than 1 cm.

FIG. 3A shows a non-limiting example of the visor 30 and the visor arm 32*a* coupled to the helmet body 12 with one or more connectors, snaps, or rivets 80 to physically or mechanically couple or fasten the visor 30 to the helmet body 12. In some embodiments, connectors 80 can also employ magnetic or chemical attachment. In any event, the connectors 80 can allow for a desired amount of rotation or relative movement between the visor 30 and the helmet body 12. While a right side of the helmet 10 is shown in the FIGS., a person of ordinary skill in the art will understand that the helmet 10 can comprise bilateral symmetry such that the second or left side of the helmet 10, including the second or left visor arm 32*b*, not shown, would be identical or a mirror image to the first or right side of the helmet 10 and the first or right visor arm 32*a*. The visor 30 and the visor arms 32 can be coupled to the helmet body 12 to form the interface 74 between the visor electrical contact 70 and the helmet electrical contact 26. The interface 74 can configure or adapt the helmet 10 for electrical communication between the controls 40 and electronic device 20 through the visor 30.

The interface 74 can be of a nature and type so as to be adapted to allow for any relative movement or rotation permitted or facilitated by the connectors 80. In some instances, the electrical connection at interface 74 can be made without the use of wires, such as by using flat or planar conductive structures that contact each other to provide electrical connectivity while allowing for relative movement, such as helmet electrical contact 26 and visor electrical contact 70. Alternatively, wires or any other suitable structure can also be used for providing electrical interconnection between the controls 40 and the one or more electronic devices 20 within the helmet 10, wherein the one or more electronic devices 20 can include a video camera, a panoramic or 360 degree camera, a recording device, a battery, a portable audio device, wireless communication transmitting and receiving devices, or other devices. When wires are used as part of the interface 74, the wires can comprise ends or attachment areas that allow for the wires to be releasably coupled, and separated from, each other at the interface 74 to facilitate and allow for changing or replacement of visors 30 and electrical connection with the new visor 30 and the new controls 40. Replacement of visors 30, allows for visors 30 to be interchanged based on functionality (e.g., needed replacement for a defective or broken part or to swap out a visor adapted to a particular set of electronic devices for another visor adapted to a different set of electronic devices), for adaptability (e.g., to accommodate different designs or sizes of visors), and for aesthetics (e.g., different colors or styles of visors).

FIG. 3B shows additional detail of the first visor arm 32*a* from FIG. 3B, by showing the inner or medial surface 72 of the visor arm that is oriented toward the helmet body 12, which was not shown in the view of FIG. 3A. Thus, FIG. 3B shows the visor electrical contacts 70 on the inner surface 72, as well as opening 82 that extends completely through the visor arm 32*a* for receiving the connector 80. FIG. 3B illustrates that the connector 80 can extend through the opening 82 in the visor arm 32*a* to releasably couple the visor 30 to the helmet body 12 as part of the helmet 10. In other instances, the visor 30 can be formed without openings 82, having instead connectors 80 being integrally formed with, or coupled to, the visor 30 or the visor arm 32 for attachment to the helmet body 12 at a corresponding opening or attachment location in or on the helmet body 12.

The formation of the helmet 10 as shown and discussed herein provides for a number of advantages with respect to conventional helmets. The fully integrated electronic controls 40 allow for a helmet wearer to easily control or adjust function of one or more electronic devices 20, while using a wired connection through the visor 30 to the helmet body 12 that can be more energy efficient and robust than a wireless connection. Manipulation of the electronic device 20 can occur while the helmet user is wearing the helmet 10, and is further engaged in riding, because of the convenient positioning of the controls 40 on the visor 30 for easy access and manipulation of the controls 40, such as within the FOV 62. Helmet 10 provides for seamless integration of electronic devices 20 within the helmet 10, for increased ease of use with the placement and interconnectedness of controls 40 through interface 74, for optimized functionality, and for facilitating manufacturing and assembly. Ease of replacing and interchanging the visor 30 is facilitated by routing electrical connection and electrical communication through interface 74 between helmet electrical contact 28 and visor electrical contact 70.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet comprising:

a helmet body comprising an energy-absorbing layer and an outer shell disposed over, and coupled to, the energy-absorbing layer, wherein the energy-absorbing layer comprises expanded polypropylene (EPP), expanded polystyrene (EPS), expanded polyurethane (EPU), or expandable polyolefin (EPO);

an electronic device integrated with the helmet body;

a first electrical contact formed at an exterior of the outer shell and adapted to be in electrical communication with the electronic device;

a helmet visor coupled to the helmet body with at least one visor arm, the helmet visor comprising controls integrated within the visor; and a second electrical contact formed at an inner surface of the at least one visor arm and positioned such that an interface between the first electrical contact and the second electrical contact is formed, the second electrical contact and the first electrical contact being in electrical communication with each other through the interface, the second electrical contact being in electrical communication with the controls integrated within the visor, the second electrical contact being mateably coupled with the first electrical contact at the interface between the first electrical contact and the second electrical contact such that the electronic device and the controls integrated within the visor are in electrical contact with each other through the interface.

2. The helmet of claim 1, wherein the helmet visor is releasably coupled to the helmet body.

3. The helmet of claim 1, wherein the controls integrated within the helmet visor are formed as a plurality of buttons.

4. The helmet of claim 3, wherein the plurality of buttons collectively comprise a unitary protective cover adapted to prevent debris from contaminating the plurality of buttons.

5. The helmet of claim 3, wherein the controls are disposed on an underside of the helmet visor at a position that is within a field of view of the helmet, such that the controls are visible by a helmet user when the helmet is worn by the helmet user.

6. The helmet of claim 1, wherein the electronic device integrated with the helmet body comprising a video recording device with a lens disposed over the outer shell.

7. The helmet of claim 1, wherein the at least one visor arm comprises a first visor arm and a second visor arm opposite the first visor arm, the first visor arm and the second visor arm being adapted to be coupled to the helmet body near an upper corner of a helmet faceport.

8. A helmet comprising:

a helmet body comprising an outer shell;

an electronic device integrated with the helmet body;

a first electrical contact formed at an exterior of the outer shell of the helmet body and adapted to be in electrical communication with the electronic device;

a helmet visor coupled to the helmet body with at least one visor arm, the helmet visor comprising controls integrated within the visor; and a second electrical contact formed at an inner surface of the at least one visor arm and positioned such that an interface between the first electrical contact and the second electrical contact is adapted to mateably couple the first electrical contact with the second electrical contact at the interface such that the electronic device and the controls integrated within the visor are in electrical contact with each other through the first electrical contact, the second electrical contact, and the interface.

9. The helmet of claim 8, wherein the helmet visor is releasably coupled to the helmet body.

10. The helmet of claim 8, wherein the controls integrated within the helmet visor are formed as a plurality of buttons.

11. The helmet of claim 10, wherein the controls are disposed on an underside of the helmet visor at a position that is within a field of view of the helmet, such that the controls are visible by a helmet user when the helmet is worn by the helmet user.

12. The helmet of claim 10, wherein the plurality of buttons collectively comprise a unitary protective cover adapted to prevent debris from contaminating the plurality of buttons.

13. The helmet of claim 8, wherein the electronic device integrated with the helmet body comprising a video recording device with a lens disposed over the outer shell.

14. The helmet of claim 8, further comprising:

the at least one visor arm comprising a first visor arm and a second visor arm opposite the first visor arm, the first visor arm and the second visor arm being adapted to be coupled to the helmet body near an upper corner of a helmet faceport; and the helmet body comprising an energy-absorbing layer including at least one of expanded polypropylene, expanded polystyrene, expanded polyurethane, or expanded polyolefin.

* * * * *